United States Patent [19]

Popp

[11] 4,079,286

[45] Mar. 14, 1978

[54] GRID HAVING REDUCED SECONDARY EMISSION CHARACTERISTICS AND ELECTRON DISCHARGE DEVICE INCLUDING SAME

[75] Inventor: Hans Popp, Lancaster, Pa.

[73] Assignee: RCA Corporation, New York, N.Y.

[21] Appl. No.: 745,408

[22] Filed: Nov. 26, 1976

[51] Int. Cl.[2] ..... H01J 31/38; H01J 29/02

[52] U.S. Cl. ..... 313/389; 313/458; 13/106

[58] Field of Search ..... 313/383, 390, 395, 378, 313/384, 377, 348 (U.S. only), 389, 376, 452, 387, 382, 379

[56] References Cited

U.S. PATENT DOCUMENTS

| | | | |
|---|---|---|---|
| 2,212,827 | 8/1940 | Etzrodt | 313/348 X |
| 3,073,981 | 1/1963 | Miller et al. | 313/390 |
| 3,136,916 | 6/1964 | Schaefer | 313/377 |

*Primary Examiner*—Robert Segal

*Attorney, Agent, or Firm*—E. M. Whitacre; G. H. Bruestle; R. M. Rodrick

[57] ABSTRACT

A nickel oxide surface layer of a nickel mesh supporting structure is coated with a layer of chromium. The nickel oxide layer has a thickness of between about 500 to 750A. The layer chromium is at least about 100A thick. The chromium coated nickel oxide-nickel mesh is particularly suitable for use in vidicon tubes.

16 Claims, 3 Drawing Figures

GRID HAVING REDUCED SECONDARY EMISSION CHARACTERISTICS AND ELECTRON DISCHARGE DEVICE INCLUDING SAME

BACKGROUND OF THE INVENTION

This invention relates to a grid for use in electron discharge devices, and particularly to a nickel mesh grid which has been coated with a layer of chromium.

A vidicon tube is one form of an electron discharge device. In the vidicon tube, an optical input is converted into an electrical output. In one such device, one surface of a photoconductive target is exposed to the optical input. The optical input is transformed into an electrical output by exposing the opposing surface of the photoconductive target to a scanning electron beam. Generally, a mesh grid is disposed between the photoconductive target and an electron gun which provides the scanning electron beam. One purpose of this grid is to ensure that the scanning electron beam possesses the proper energy, e.g., a few volts, when it strikes the photoconductive target. Another purpose of this grid is to ensure that the scanning electron beam strikes the photoconductive target at the proper locations.

Most of the grids used in these devices are copper meshes which have been prepared by electroforming onto a master pattern which has been etched on a glass plate. After the electroforming process, the mesh is mounted in a supporting structure and fired in hydrogen. This is done to make the mesh taut and to outgas the mesh so as to make it suitable for use in a vacuum tube. However, one problem associated with the use of the copper mesh grid is that, during firing, the structure stretches taut due to continued grain growth. This stretching results in a mesh which is not as strong as desirable. Indeed, in some instances, especially after long or repeated heating periods, the copper mesh may even collapse. It should be noted that most particle matter present on the mesh before firing result in mesh blemishes which make the mesh unusable for satisfactory tube operation. Repeated firing, or extended firing periods, are often required in order to reduce the magnitude of this problem. Also, the use of copper mesh grids has been plagued by continuous production yield fluctuations in the electroforming process.

Although the use of a nickel mesh grid would appear to be an alternative to the use of copper, this has not occurred. One problem is that, after being air baked and hydrogen fired, the mesh is often insufficiently taut and may exhibit a relatively high secondary emission coefficient ($\delta$) so as to make the mesh grid unusable in several vidicon tubes. The secondary emission problem can be substantially reduced by coating the mesh with a layer of chromium as disclosed in U.S. Pat. No. 3,136,916, entitled, "Image Orthicon Tube Having Specially Coated Decelerating Field Electrode", issued June 9, 1964 to D. Schaefer. However, even when so coated, the mesh is insufficiently taut with relatively low resonant frequencies, i.e., below 3000 hertz. These meshes frequently result in microphonics in tubes, i.e., translation of vibration or shock into an electrical signal with measurable amplitude and duration.

Thus, it would be desirable to develop a taut mesh grid that can be mass produced with high yields without creating secondary emission problems.

SUMMARY OF THE INVENTION

A grid for an electron discharge device includes a nickel mesh supporting structure having a layer of nickel oxide. A layer of chromium is disposed on at least one surface of the nickel mesh supporting structure.

DETAILED DESCRIPTION OF THE INVENTION

Figure 1:
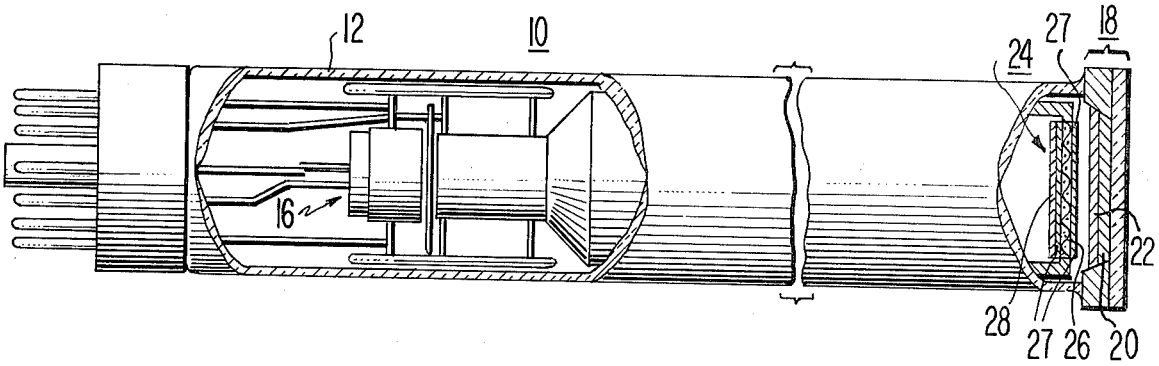
FIG. 1 is a longitudinal and partly sectional view showing one form of an electron discharge device which includes the grid of the present invention.

Referring initially to FIG. 1, a conventional vidicon is designated generally as 10. The vidicon 10 comprises an evacuated envelope 12 having an electron gun 16 at one end. The electron gun 16 may be any of the known types and produces an electron beam directed toward a target electrode 18 in the other end of the envelope 12. The target electrode 18 comprises a transparent electrical conductor 20, such as tin oxide, having a layer of photoconductive material 22 thereon. The photoconductive layer 22 may comprise conventional photoconductive materials, such as antimony trisulfide.

Figure 2:
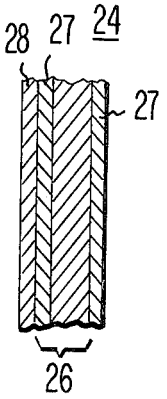
FIG. 2 is an edge view of a portion of the mesh grid of FIG. 1.

Disposed between the target electrode 18 and the electron gun 16 is a mesh grid 24. The mesh grid 24 is of the type which includes 1000 lines per inch in mutually orthogonal relation. This results in grid squares of about 0.0005 × 0.0005 inch (12 × 12 microns). The thickness of the grid is about 0.002 inch (5 microns). The mesh grid 24 includes a nickel mesh supporting structure 26. The nickel mesh supporting structure 26 includes opposing nickel oxide surface layers 27. Each of the nickel oxide surface layers 27 has a thickness of about 500 to 750A. The nickel oxide surface layer 27 which faces the electron gun 16 is coated with a layer 28 of chromium. The layer 28 of chromium is typically between about 500 to about 750A in thickness. The structure of the mesh grid 24 can be seen more clearly in FIG. 2. Due to its structure, this form of the grid 24 of the present invention can be conveniently referred to as a chromium coated nickel oxide-nickel mesh grid.

The mesh grid 24 can be constructed using conventional electroforming and deposition techniques. For example, nickel can be electroformed onto the appropriate chromium master pattern. The electroformed nickel is then peeled off the master at which point it assumes mesh form. The nickel mesh is then placed into a supporting ring and is maintained under slight tension by welding a thin metal ring to the nickel mesh and supporting ring. The nickel mesh, together with the supporting and welding rings, is then baked in air at a temperature of about 415° C for about 45 minutes. As a result of this treatment, the nickel mesh surface is deliberately converted into nickel oxide, i.e., a nickel oxide surface layer is formed. Chromium is then deposited, e.g., evaporated, onto the surface of the oxidized nickel mesh which is to face the electron gun.

It appears that the presence of the nickel oxide layer is responsible for the tauter structure of the nickel mesh of the present invention as compared to a conventional nickel mesh structure. In this connection, it is believed that the crystal structure of the nickel oxide contributes to higher internal damping of fibrations. With regard to tautness, I have found that, in general, the nickel oxide layer should have a thickness greater than about 300A. This oxide thickness can be obtained by employing processing techniques which include the deliberate formation of an oxide layer of the necessary thickness. The layer 28 of chromium effectively suppresses the secondary emission which would otherwise occur at the nickel oxide surface. In addition, the chromium layer 28 hides most surface blemishes which may appear in the mesh supporting structure 26. Thus, the use of the chromium layer can enhance the salvage of nickel meshes having surface blemishes. Indeed, in practice the only meshes which must be rejected are those meshes in which unremovable foreign matter is blocking the mesh spaces. In addition, the chromium coated nickel oxide-nickel mesh is significantly stronger mechanically than the conventional copper mesh. It should be noted that the increased strength of the chromium coated nickel oxide-nickel mesh has not been accomplished at the expense of creating secondary emission problems. Indeed, secondary electron emission from the chromium coated nickel oxide-nickel mesh has been reduced to a degree so as to be equivalent in tube operation to the copper mesh.

Figure 3:
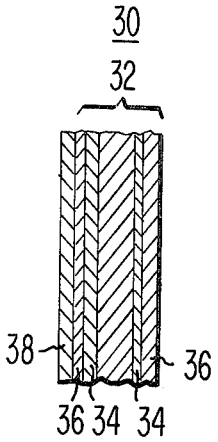
FIG. 3 is an edge view of a portion of another form of mesh grid of the present invention.

A variation of the mesh grid of the present invention is partially shown in FIG. 3. This mesh grid, designated generally as 30, includes a nickel mesh supporting structure 32 which is modified with respect to the previously described nikel mesh supporting structure 26. The nickel mesh supporting structure 32 includes a pair of opposed nickel oxide layers 34 and a pair of opposed nickel surface layers 36. A chromium layer 38 is disposed on one of the nickel surface layers 36. The mesh grid 30 is referred to as a chromium coated nickel mesh in contrast to the previously described chromium coated nickel oxide-nickel mesh. The thickness of the nickel mesh supporting structure 32 is substantially the same as the corresponding element of the previously described mesh grid 24. The thickness of each of the nickel surface layers 36 is about 50A, their thickness not being critical. As in the previously described mesh grid 24, the thickness of the chromium layer 38 is between about 500 to about 750A.

In this variation, processing is substantially the same as described earlier. However, after baking the nickel mesh in air, the oxidized nickel mesh is fired for a short time in hydrogen where a thin surface layer is reconverted into nickel. This step provides the nickel surface layers 38 which are not present in the previously described mesh grid 24. It should be noted that the hydrogen firing loosens the structure of the nickel mesh by removing some of the nickel oxide so that the tension of the chromium coated nickel mesh is slightly lower than the tension of the chromium coated nickel oxide-nickel mesh. In addition, this variation requires an additional processing step in order to reconvert some of the nickel oxide into nickel, i.e., firing in hydrogen. However, it should be noted that in those instances where contamination during electroforming is a concern, hydrogen firing may be a desirable part of the processing.

With regard to production yields, I have found that the chromium coated nickel oxide-nickel mesh grid of the present invention produces less mesh related tube scrap than either the uncoated nickel mesh grid or the conventional copper mesh grid. For example, in a production run of 1283 complete vidicon tubes, mesh related tube scrap was 0.70%. In this production run, the mesh related tube scrap for 549 chromium coated nickel oxide-nickel mesh was 0.55%. The mesh related tube scrap for a mixed group of 734 tubes of hydrogen fired uncoated nickel mesh and conventionally prepared copper mesh was 0.82%. The mesh related tube scrap for hydrogen fired uncoated nickel mesh is similar to the scrap performance of conventional copper mesh so that the above comparison is based on a variable mix of standard mesh types.

With regard to microphonics, the nickel mesh supporting structure of the present invention has a resonant frequency of about 2800 hertz whereas a conventional nickel mesh has a resonant frequency of about 2450. The chromium layer further increases the resonant frequency of the mesh grid by about 300 to 500 hertz. Thus, the mesh grid of the present invention has a resonant frequency of about 3100 to 3300 hertz so as to be less likely to cause microphonics during tube operation.

Although the chromium coated nickel mesh grid of the present invention has been described with regard to vidicon tubes, it should be apparent that this grid is suitable for use in other forms of electron discharge devices in which an electron beam impinges upon a grid. However, it is desirable that the intended operation of the mesh grid be at temperatures of less than about 600° C as temperatures in excess thereof may cause loosening of the mesh. It should be noted that in any tube application, in order to prevent secondary emission at the grid, it is necessary that the chromium layer be of a thickness which is greater than the penetration depth at which the primary electrons which strike the grid after being emitted by the electron gun still possess enough energy to produce secondary electron emission. Also, with regard to the chromium layer in any variation, it is only necessary to deposit the chromium on the side of the mesh which is scanned by the electron beam.

Thus, there is provided by the present invention, a mesh grid which utilizes the advantages of nickel oxide, namely tauter structure and less handling, while suppressing the disadvantage of nickel oxide, i.e., high secondary emission. In addition, the use of the chromium layer makes it possible to use mesh which would otherwise be considered to be too blemished, resulting in increased yield.

I claim:

1. A grid for an electron discharge device, which comprises:

a nickel mesh supporting structure including a layer of nickel oxide; and a layer of chromium disposed on at least one surface of said nickel mesh supporting structure.

2. A grid in accordance with claim 1 in which said surface of said nickel mesh supporting structure includes said layer of nickel oxide.

3. A grid in accordance with claim 1 in which said nickel oxide layer has a thickness of at least about 300A.

4. A grid in accordance with claim 3 in which said nickel oxide layer has a thickness between about 500 to 750A.

5. A grid in accordance with claim 3 in which said chromium layer has a thickness of at least about 100A.

6. A grid in accordance with claim 5 in which said chromium layer has a thickness of between about 500 to about 750A.

7. A grid in accordance with claim 6 in which said chromium layer is disposed on only said one surface of said nickel mesh supporting structure.

8. A grid in accordance with claim 1 in which said surface of said nickel mesh supporting structure includes a surface layer of nickel.

9. An electron discharge device, which comprises:

an evacuated envelope;

an electron gun at one end of said envelope for producing an electron beam;

a target at the other end of said envelope, said target including a transparent conductor layer and a photoconductor layer; and a grid disposed between said electron gun and said target, said grid comprising a nickel mesh supporting structure, said supporting structure including a layer of nickel oxide, said supporting structure having at least one surface facing said electron gun, said surface being coated with a layer of chromium.

10. An electron discharge device in accordance with claim 9 in which said surface of said nickel mesh supporting structure includes said layer of nickel oxide.

11. An electron discharge device in accordance with claim 9 in which said nickel oxide layer has a thickness of at least about 300A.

12. An electron discharge device in accordance with claim 11 in which said nickel oxide layer has a thickness of between about 500 to 750A.

13. An electron discharge device in accordance with claim 11 in which said chromium layer has a thickness which is greater than the penetration depth of electrons which strike said grid after being emitted by said electron gun.

14. An electron discharge device in accordance with claim 11 in which said chromium layer is at least about 100A thick.

15. An electron discharge device in accordance with claim 14 in which said chromium layer is between about 500 to about 750A thick.

16. An electron discharge device in accordance with claim 9 in which said surface of said nickel mesh supporting structure includes a surface layer of nickel.

* * * * *